US009241533B2

(12) United States Patent
Heard et al.

(10) Patent No.: US 9,241,533 B2
(45) Date of Patent: Jan. 26, 2016

(54) FOOTWEAR INCLUDING HEEL SPRING SUPPORT MEMBERS

(71) Applicant: NIKE, Inc., Beaverton, OR (US)

(72) Inventors: Joshua P. Heard, Happy Valley, OR (US); Robert M. Bruce, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 519 days.

(21) Appl. No.: 13/773,041

(22) Filed: Feb. 21, 2013

(65) Prior Publication Data

US 2014/0230280 A1 Aug. 21, 2014

(51) Int. Cl.

| | |
|---|---|
| ***A43B 13/18*** | (2006.01) |
| ***A43B 7/14*** | (2006.01) |
| ***A43B 7/38*** | (2006.01) |
| ***A43B 17/02*** | (2006.01) |

(52) U.S. Cl.
CPC . *A43B 7/144* (2013.01); *A43B 7/38* (2013.01); *A43B 13/183* (2013.01); *A43B 17/02* (2013.01); *A43B 17/023* (2013.01)

(58) Field of Classification Search
CPC ... A43B 13/183; A43B 13/181; A43B 13/184
USPC ..... 36/27, 38, 7.8
See application file for complete search history.

(56) References Cited

U.S. PATENT DOCUMENTS

| | | | | |
|---|---|---|---|---|
| 1,471,966 | A * | 10/1923 | Light | A43B 13/183 36/38 |
| 1,920,112 | A | 7/1933 | Shaft | |
| 2,383,877 | A * | 8/1945 | Miller | A43B 21/30 36/38 |
| 2,424,609 | A | 7/1947 | Friedmann, Jr. | |
| 2,447,603 | A | 8/1948 | Snyder | |
| 2,508,318 | A | 5/1950 | Wallach | |
| 2,767,487 | A | 10/1956 | Friedmann, Jr. | |
| D252,836 | S | 9/1979 | Picker | |
| 4,492,046 | A | 1/1985 | Kosova | |
| 4,534,124 | A | 8/1985 | Schnell | |
| 4,566,206 | A * | 1/1986 | Weber | A43B 21/26 36/27 |
| 4,592,153 | A | 6/1986 | Jacinto | |
| 5,138,776 | A | 8/1992 | Levin | |
| 5,195,258 | A | 3/1993 | Loader | |
| 5,435,079 | A | 7/1995 | Gallegos | |
| 5,701,686 | A | 12/1997 | Herr et al. | |
| 5,826,350 | A | 10/1998 | Wallerstein | |
| 5,875,567 | A | 3/1999 | Bayley | |
| 6,341,432 | B1 | 1/2002 | Muller | |
| 6,449,878 | B1 | 9/2002 | Lyden | |

(Continued)

FOREIGN PATENT DOCUMENTS

| | | | | |
|---|---|---|---|---|
| FR | 2507066 | A1 * | 12/1982 | A43B 13/18 |

*Primary Examiner* — Ted Kavanaugh
(74) *Attorney, Agent, or Firm* — Banner & Witcoff, Ltd.

(57) ABSTRACT

A shoe includes spring type support members, optionally for at least a heel area of a foot. The support member includes a primary biasing element in the form of a V-shaped spring assembly and a secondary biasing element provided at least partially within a volume defined by the primary biasing element (e.g., between its base member and its flexing member, beneath the flexing member, etc.). When the primary biasing element compresses beyond a predetermined extent, it will compress the secondary biasing element. This construction allows the degree of ground reaction force attenuation and energy absorption properties of a shoe to be dually controlled to meet the specific demands of the activity for which the footwear is intended to be used.

25 Claims, 11 Drawing Sheets

(56) References Cited

U.S. PATENT DOCUMENTS

| | | | | |
|---|---|---|---|---|
| 6,557,271 | B1 | 5/2003 | Weaver, III | |
| 6,860,034 | B2 | 3/2005 | Schmid | |
| D507,094 | S | 7/2005 | Lyden | |
| 6,925,732 | B1 | 8/2005 | Clarke | |
| 6,928,756 | B1 | 8/2005 | Haynes | |
| 6,964,119 | B2 | 11/2005 | Weaver, III | |
| 7,100,308 | B2 | 9/2006 | Aveni | |
| 7,574,817 | B2 * | 8/2009 | Fechter | A43B 13/141 36/27 |
| 7,814,683 | B2 * | 10/2010 | Lee | A43B 13/026 36/25 R |
| 2002/0133977 | A1 * | 9/2002 | Pan | A43B 21/26 36/28 |
| 2005/0102859 | A1 | 5/2005 | Yen | |
| 2006/0010715 | A1 * | 1/2006 | Tseng | A43B 3/0063 36/11.5 |
| 2006/0130362 | A1 | 6/2006 | Juan | |
| 2013/0118028 | A1 * | 5/2013 | Yoon | A43B 13/143 36/27 |

* cited by examiner

FOOTWEAR INCLUDING HEEL SPRING SUPPORT MEMBERS

BACKGROUND

Conventional articles of athletic footwear include two primary elements, namely, an upper and a sole structure. The upper is usually formed of leather, synthetic materials, or a combination thereof and comfortably secures the footwear to the foot, while providing ventilation and protection from the elements. The sole structure often incorporates multiple layers that are conventionally referred to as an insole, a midsole, and an outsole. The insole is a thin, relatively soft member located within the upper and adjacent the sole of the foot to enhance footwear comfort. The midsole, which is traditionally attached to the upper along the entire length of the upper, forms the middle layer of the sole structure and serves a variety of purposes that include controlling potentially harmful foot motions, such as over pronation; shielding the foot from excessive ground reaction forces: and beneficially utilizing such ground reaction forces for more efficient toe-off. In order to achieve these purposes, the midsole may have a variety of configurations as discussed in greater detail below. The outsole forms the ground-contacting element of footwear and is usually fashioned from a durable, wear resistant material that includes texturing or other features to improve traction.

The primary element of a conventional midsole is a resilient, polymer foam material, such as polyurethane or ethylvinylacetate, that extends through the length of the footwear. The properties of the foam midsole are primarily dependent upon factors that include the dimensional configuration of the midsole, the material selected for the polymer foam, and the density of the midsole material. By varying these factors throughout the midsole, the relative stiffness, degree of ground reaction force attenuation, and energy absorption properties may be altered to meet the specific demands of the activity for which the footwear is intended to be used.

SUMMARY

This Summary is provided to introduce a selection of concepts relating to this invention in a simplified form that are further described below in the Detailed Description. This Summary is not intended to identify key features or essential features of the invention.

In at least some embodiments, shoes and/or articles of footwear can include an upper and a sole structure engaged with the upper, wherein the sole structure includes a support member for at least a portion of a plantar surface of the foot. More specifically, the support member may be located at least in a heel area of the article of footwear. The support member may include a primary biasing element and a secondary biasing element, e.g., located at least partially within a volume defined by the primary biasing element, located beneath a moving portion of the primary biasing member, etc. The primary biasing element may be in the form of a V-shaped spring assembly that includes a base member and a flexing member. When the flexing member compresses or deflects toward the base member, the flexing member may compress or deflect the secondary biasing element, at least under some conditions. The base member may be an elongate, rectangular, substantially rigid plate formed integrally with the sole structure. The flexing member may be an elongate, rectangular, substantially rigid plate formed integrally with the sole structure and/or with the base member. The primary biasing element may further include a biasing member that provides a V-shaped apex, wherein this biasing member integrally joins the base member and the flexing member. The secondary biasing member may constitute a generally C-shaped, circular shaped, or oval shaped element (in cross section) that engages the flexing member at least under some conditions.

In at least some aspects of this invention, the heel support member may provide two stage impact force attenuation under at least some conditions. For example, under lighter loads (e.g., when a user is standing still, or potentially even when they are walking around), only the primary biasing element may be operating (e.g., the V-shaped spring assembly (in cross section) of the primary biasing element may provide adequate impact force attenuation and/or bending resistance to support the user's weight under these lighter load conditions without necessarily engaging the secondary biasing element). This feature may provide a nice soft feel underfoot under the light load conditions. Under heavier load conditions, however (e.g., when a user lands a running step or a jump, etc.), the primary biasing element may compress to a sufficient extent to engage the secondary biasing element, which can then also compress or deflect to absorb the remaining load. In this manner, the initial landing under the heavier load condition still will have a soft initial feel (while the primary biasing element is initially compressing or deflecting unimpeded by the secondary biasing element), but sufficient impact force attenuation and support is provided to absorb the remainder of the heavier impact load as the secondary biasing element is compressed or deflected (preferably before both biasing elements "bottom out"). As the load is released or relaxed (e.g., as the wearer's weight moves off the heel area during push off of a step or jump), the spring features of the primary and/or secondary biasing elements will return those element(s) to their original configuration(s) and shape(s) (e.g., as the biasing elements return to their uncompressed or unbent conditions), which provides return energy (or bounce back energy) to the wearer's foot.

In at least some embodiments, the primary biasing element may include a raised perimeter wall that extends around at least a portion of a rear heel area of the flexing member, e.g., from a medial side area of the flexing member to a lateral side area of the flexing member.

Additional embodiments and/or features of the invention are described herein.

BRIEF DESCRIPTION OF THE DRAWINGS

Some embodiments and features of this invention are illustrated by way of example, and not by way of limitation, in the figures of the accompanying drawings and in which like reference numerals refer to the same or similar elements.

DETAILED DESCRIPTION

Definitions

Figure 1:
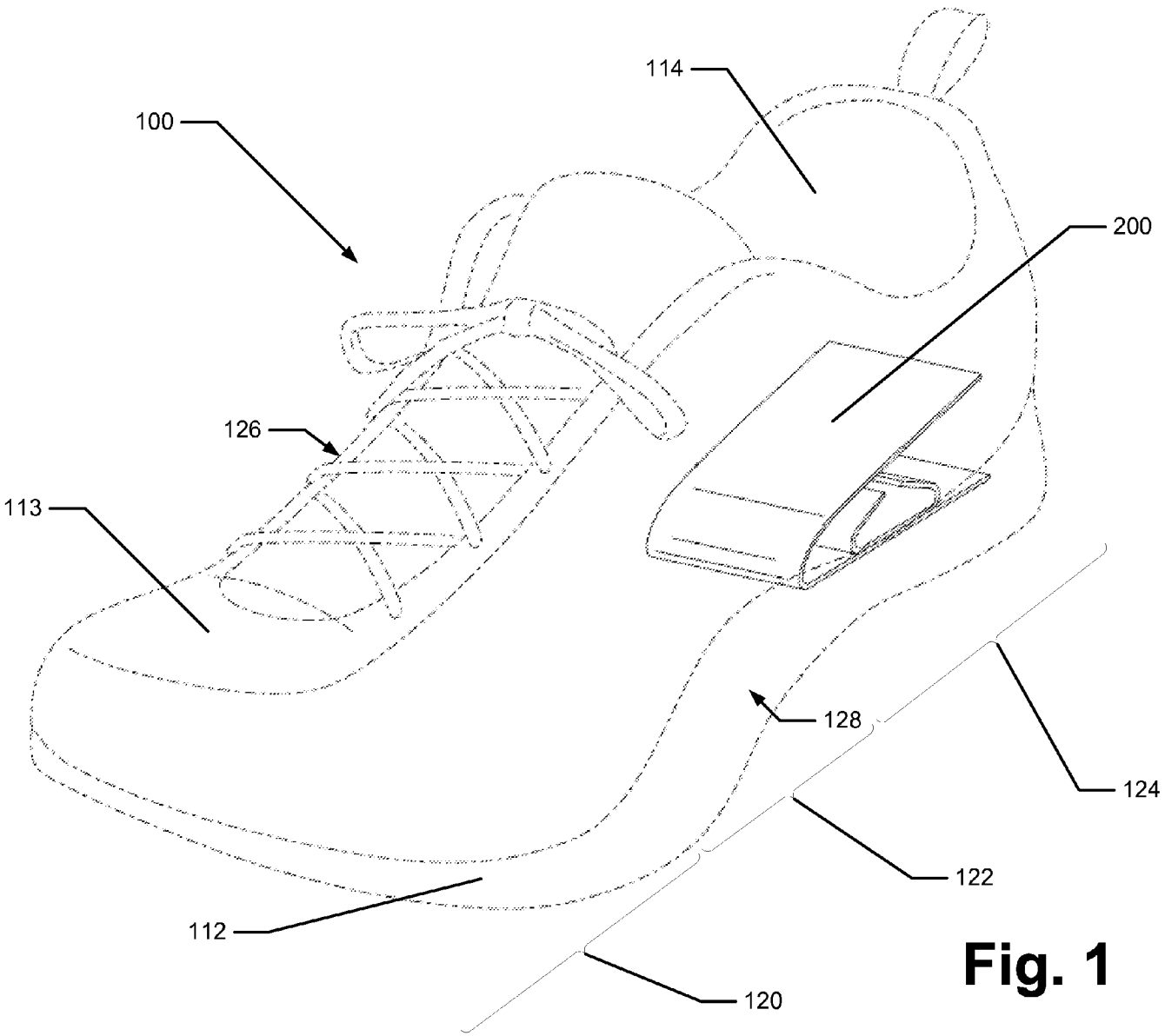
FIG. 1 illustrates an article of footwear that includes a biasing support member according to at least some embodiments of this invention.

To assist and clarify subsequent description of various embodiments of the invention, various terms are defined herein. Unless context indicates otherwise, the following definitions apply throughout this specification (including the claims). "Shoe" and "article of footwear" are used interchangeably to refer to articles intended for wear on a human foot. A shoe may or may not enclose the entire foot of a wearer. For example, a shoe could include a sandal or other article that exposes large portions of a wearing foot. The "interior" of a shoe refers to space that is occupied by a wearer's foot when the shoe is worn. An "interior side" (or surface) of a shoe element refers to a face of that element that is (or will be) oriented toward the shoe interior in a completed shoe. An "exterior side" (or surface) of an element refers to a face of that element that is (or will be) oriented away from the shoe interior in the completed shoe. In some cases, the interior side of an element may have other elements between that interior side and the interior in the completed shoe. Similarly, an exterior side of an element may have other elements between that exterior side and the space external to the completed shoe.

Shoe elements can be described based on regions and/or anatomical structures of a human foot wearing that shoe, and by assuming that shoe is properly sized for the wearing foot. As an example, a forefoot region of a foot includes the metatarsal and phalangeal bones. A forefoot element of a shoe is an element having one or more portions located over, under, to the lateral and/or medial side of, and/or in front of a wearer's forefoot (or portion thereof) when the shoe is worn. As another example, a midfoot region of a foot includes the cuboid, navicular, medial cuneiform, intermediate cuneiform and lateral cuneiform bones and the heads of the metatarsal bones. A midfoot element of a shoe is an element having one or more portions located over, under and/or to the lateral and/or medial side of a wearer's midfoot (or portion thereof) when the shoe is worn. As a further example, a hindfoot or heel region of a foot includes the talus and calcaneus bones. A hindfoot or heel element of a shoe is an element having one or more portions located over, under, to the lateral and/or medial side of, and/or behind a wearer's hindfoot or heel (or portion thereof) when the shoe is worn. The forefoot region may overlap with the midfoot region, as may the midfoot and heel regions.

In the following description of several example embodiments of this invention, reference is made to the accompanying drawings, which form a part hereof. It is to be understood that other specific arrangements of parts, example systems, and environments may be utilized and structural and functional modifications may be made without departing from the scope of the present invention. Also, while the terms "top," "bottom," "side," "front," "back," "above," "below," "under," "over," "beneath," and the like may be used in this specification to describe various example features and elements of example embodiments, these terms are used herein as a matter of convenience, e.g., based on the example orientations shown in the figures and/or a typical orientation during use. Unless indicated to the contrary, nothing in this specification should be construed as requiring a specific three dimensional orientation of structures with respect to an external object or the external environment in order to fall within the scope of this invention.

The various figures in this application illustrate examples of foot support elements and their arrangement in an article of footwear according to certain embodiments of the invention.

FIG. 1 illustrates a shoe 100 that includes a biasing support assembly 200 in accordance with at least some embodiments of this invention. So as to indicate the location of this example support assembly 200 within the shoe 100, some parts of shoe 100 are shown in FIG. 1 with broken lines. The shoe 100 includes a sole structure 112 and an upper 113. The upper 113 and sole structure 112 may be connected to one another in any suitable or desired manner, including in conventional manners known and used in the art, such as via adhesives or cements, via stitching or sewing, via mechanical connectors, via fusing techniques, or the like. The upper 113 forms a foot-receiving chamber into which a wearer's foot may be inserted, e.g., via opening 114. Also, as is conventional, the sole structure 112 may include a comfort-enhancing insole (not shown in FIG. 1), a resilient midsole member (e.g., formed, at least in part, from a polymer foam material, as described above) through at least a portion of the foot supporting area, and a ground-contacting outsole member that may provide both abrasion-resistance and traction. The shoe 100 (or other foot-receiving device structure) further may include one or more closure elements or systems of any suitable or desired type without departing from this invention, including conventional closure elements and/or systems known and used in the art. Examples of such closure systems include: laces, zippers, buckles, hook-and-loop fasteners, snaps, etc. In at least some example embodiments, the shoe 100 may constitute an article of athletic footwear.

For purposes of reference, the shoe 100 may be divided into three general areas: a forefoot area 120, a midfoot area 122, and a heel area 124, as shown in FIG. 1. Areas 120-124 are intended to represent general regions of the shoe 100 that provide a frame of reference during the following discussion. Although areas 120-124 apply generally to the shoe 100, references to areas 120-124 may also apply specifically to the upper 113, the sole structure 112, or an individual component or portion within either of the upper 113 or the sole structure 112.

The various material elements forming the upper 113 and the sole structure 112 combine to form a structure having a lateral side 126 and an opposite medial side 128, as shown in FIG. 1. The lateral side 126 extends through each of areas 120-124 and is generally configured to contact and cover a lateral (outside) surface of the foot. The medial side 128 extends through each of areas 120-124 and is generally configured to contact and cover an opposite medial (inside) surface of the foot.

Figure 2A:
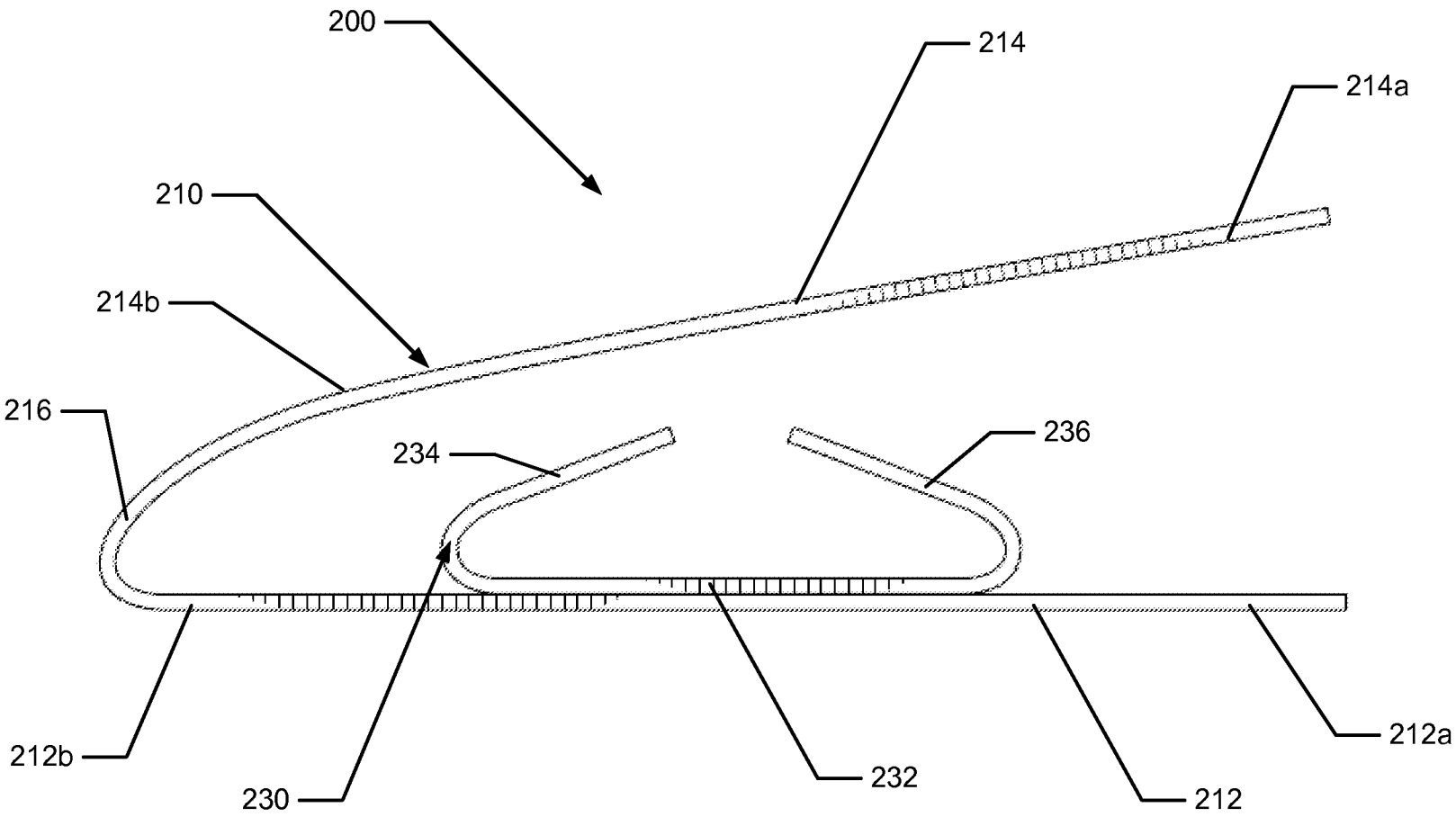
FIG. 2A illustrates a side view of a biasing support member for supporting the plantar surface of a wearer's foot, at least in a heel area, according to at least some embodiments.
Figure 2B:
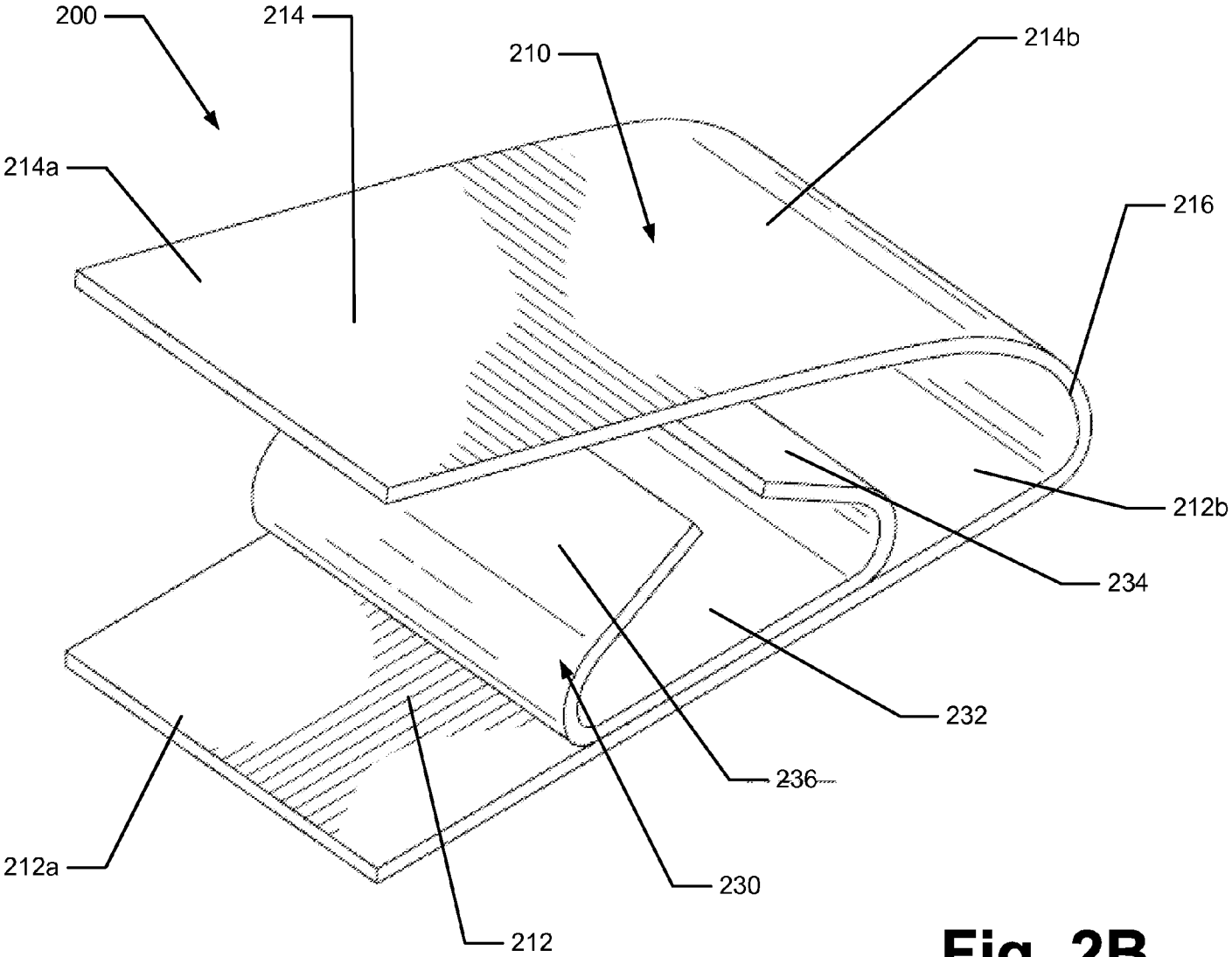
FIG. 2B illustrates an angled perspective view of the biasing support member shown in FIG. 2A.

FIGS. 2A and 2B illustrate one example of a type of foot support member in the form of a spring or biasing support assembly 200 that can help provide impact force attenuation and a soft feel underfoot, optionally in combination with a conventional midsole, and also can provide return energy to the plantar surface of a wearer of a shoe 100. The support assembly 200 illustrated in FIGS. 1, 2A, and 2B provides support for at least a heel area of a plantar surface of a wearer's foot. This spring type support assembly 200 may be provided at any desired location within a shoe construction, e.g., immediately beneath an insole, sock liner, or strobel member; included within or on top of a midsole component; between a midsole component and an outsole component; between a strobel member and an outsole component; etc.

FIG. 2A illustrates a side view of the support assembly 200 for supporting the plantar surface of a wearer's foot, and FIG. 2B shows a top-perspective view of this support assembly 200. The support assembly 200 includes primary biasing element 210 and a secondary biasing element 230. The primary biasing element 210 and the secondary biasing element 230 may be fixed to each other or engaged with each other by many known methods, such as via adhesives or cements, via mechanical connectors, via fusing techniques, or the like. The various elements of the support assembly 200 may be made from any desired materials without departing from this invention, including metals, metal alloys, polymers, composite materials, fiber-reinforced materials, and the like (e.g., rigid polymeric materials), provided the various regions and members as constructed are capable of functioning in the manner described in more detail below. Some more specific examples of suitable materials include: thermoset plastics; thermopolymers (such as thermoplastic polyurethanes, polyamides, nylons, etc.); polymer resins (such as polyesters or epoxies) having reinforcing fibers (e.g., carbon fibers, basalt fibers, glass fibers, etc.) embedded therein; and the like. Also, the support assembly 200 may be made of any number of individual parts without departing from this invention, including a two-piece construction as shown in FIGS. 1, 2A, and 2B. As other options, the support assembly 200 may be made from rigid plastic materials as one, two, or even more pieces, e.g., by molding techniques.

In this illustrated example structure 200, the primary biasing element 210 is located in the heel area 124 of the shoe 100, extending from the rear heel area 124 to the forward heel or the midfoot area 122 of the shoe 100. The primary biasing element 210 of this example includes a base member 212, a flexing member 214, and a biasing or spring member 216. The biasing member 216 may connect the base member 212 and the flexing member 214, optionally as a unitary, one-piece construction. The primary biasing element 210 may be in the form of a V-shaped spring assembly.

The base member 212 may be an elongate, substantially rigid plate that may be formed integrally as part of the sole structure 112 of the shoe 100. The base member 212 may be rectangular in shape or other shapes without departing from this invention. The base member 212 may also be located along the sole structure 112 of the shoe 100 (e.g., optionally at least partially fit into a recess, groove, or opening formed in a midsole or outsole member, if desired). The base member 212 includes a free end 212*a* and an opposite biasing end 212*b* that is attached to, adjacent to, or integrally formed with the biasing member 216. The free end 212*a* may be located closer to or at the heel area 124 of the shoe 100 while the biasing end 212*b* may be located closer to or at the midfoot area 122 of the shoe 100. The width of the base member 212 may be approximately the width of the sole structure 112 of the shoe 100 at the heel area 124, as illustrated in FIG. 1. Additionally, the width of the base member 212 may be less than the width of the sole structure 112 of the shoe 100 according to other embodiments. The base member 212 may have one or more openings defined through it, e.g., to lighten its weight, to alter its stiffness and/or flex characteristics, and/or to provide an interesting aesthetic appearance.

The flexing member 214 may also be an elongate, substantially rigid and thin plate that extends along and underlies the heel area 124 of the shoe 100. The flexing member 214 may be rectangular or other shapes without departing from this invention. The flexing member 214 includes a free end 214*a* and an opposite biasing end 214*b* that is attached to, adjacent to, or integrally formed with the biasing member 216. The free end 214*a* may be located closer to or at the heel area 124 of the shoe 100 while the biasing end 214*b* may be located closer to or at the midfoot area 122 of the shoe 100. The width of the flexing member 214 may be approximately the width of the sole structure 112 of the shoe 100 at the heel area 124 as illustrated in FIG. 1. Additionally, the width of the flexing member 214 may be less than the width of the sole structure 112 of the shoe 100 according to other embodiments. The flexing member 214 and the base member 212 may have approximately the same width. The flexing member 214 may have one or more openings defined through it, e.g., to lighten its weight, change its appearance, and/or alter its stiffness and/or flex characteristics. The flexing member 214 also may at least partially fit into a groove, recess, or opening defined in an upper or midsole component of the article of footwear, if desired.

The biasing member 216 may integrally join the base member 212 and the flexing member 214 to form the primary biasing element 210. The biasing member 216 may provide a V-shaped apex 216*a* of the primary biasing element 210. The angular configuration of the biasing member 216 and the V-shaped apex 216*a* may provide different stiffnesses and/or spring constants for the primary biasing element 210 and the spring assembly 200. The biasing member 216 may have different angular configurations and therefore differing flex characteristics in accordance with other embodiments. The type of material, the thickness of the various portions, the size and/or locations of any grooves and/or openings, and the like, may affect the flex characteristics of the primary biasing element 210. The volume defined by the primary biasing element 210 may be considered as the internal volume contained between members 212, 214, and 216 assuming that the open sides and free end are closed off by flat planar surfaces connecting the edges of the members 212, 214, 216.

Figure 8:
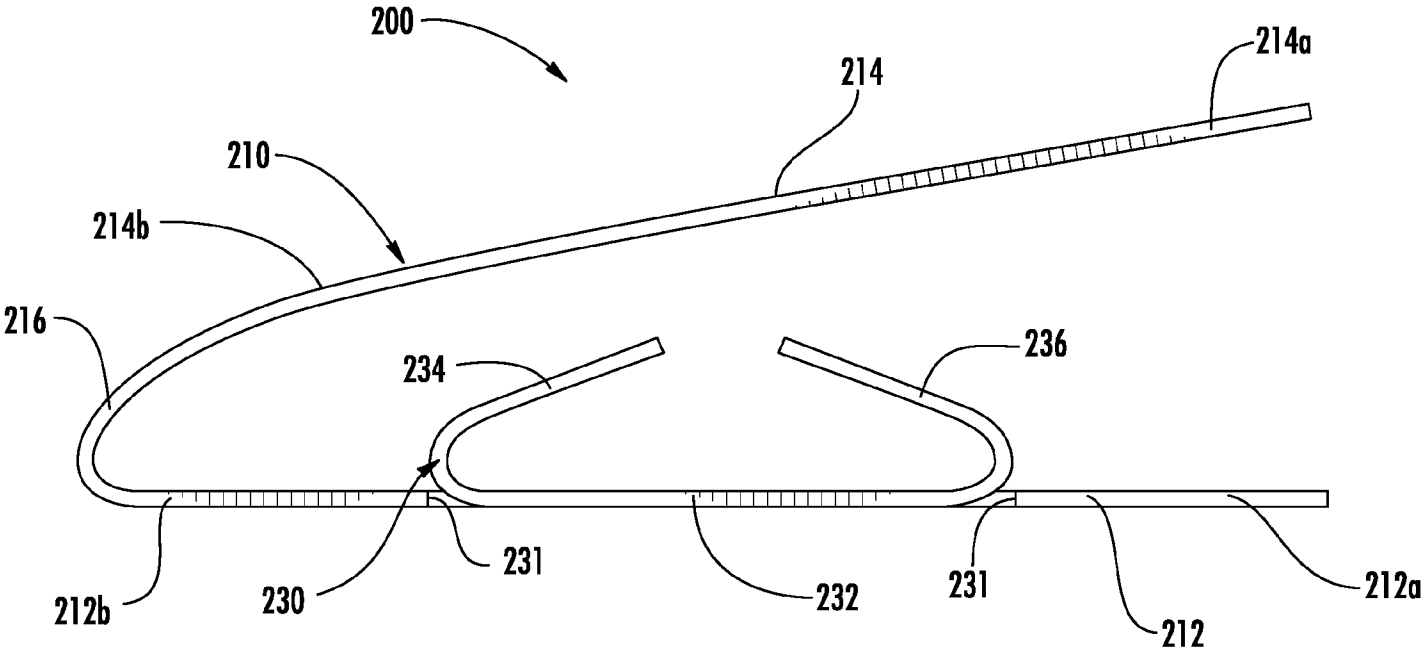
FIG. 8 illustrates a side view of an alternative embodiment of the biasing support member shown in FIG. 2A.

Additionally, in this illustrated example structure 200, a secondary biasing element 230 is located within the heel area 124 of the shoe 100. The secondary biasing element 230 may be located on and along the base member 212 of the primary biasing element 210, or it may project through an opening or groove 231 defined through the primary biasing element 210 as seen in FIG. 8. The secondary biasing element 230 may be located at least partially within the volume defined by the primary biasing element 210, e.g., at least partially between the base member 212 and the flexing member 214 or at least partially below the flexing member 214, such that the base member 212 and/or the flexing member 214 can engage the secondary biasing element 230 upon the bending or flexing of the flexing member 214 as will be described below in more detail. The secondary biasing element 230 may be in the form of a C-shaped spring member. The secondary biasing element 230 may be fixed to the primary biasing element 210 by many known methods such as via adhesives or cements, via mechanical connectors, via fusing techniques, or the like, but it need not be fixed to it (e.g., if the secondary biasing member 230 is located within a groove or opening in the primary biasing member 210, then the secondary biasing member 230 may be fixed to another footwear component, such as to any outsole or midsole structure underlying base member 212). The secondary biasing element 230 may include a base arm 232, a first flexing arm 234, and a second flexing arm 236 attached to (or integrally formed with) the base arm 232 on opposite ends. The first flexing arm 234 and the second flexing arm 236 may constitute separate parts from the base arm 232, or they may be integrally joined with the base arm 232 as a unitary, one-piece construction. The secondary biasing element 230 also may be engaged with (and thus move with) the flexing member 214, optionally with the flexing arms 234, 236 oriented to point downward toward (and move toward and into contact with) the base member 212 or another footwear component located beneath the secondary biasing element 230.

Figure 3A:
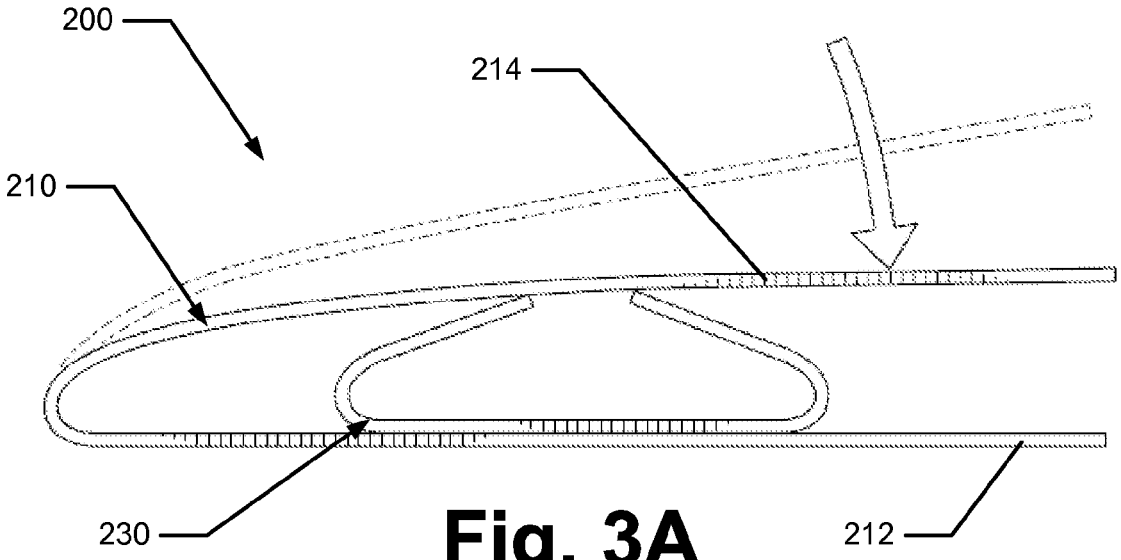
FIGS. 3A through 3C illustrate side views of the biasing support member shown in FIG. 2A during a wearer's movement in the article of footwear.
Figure 3B:
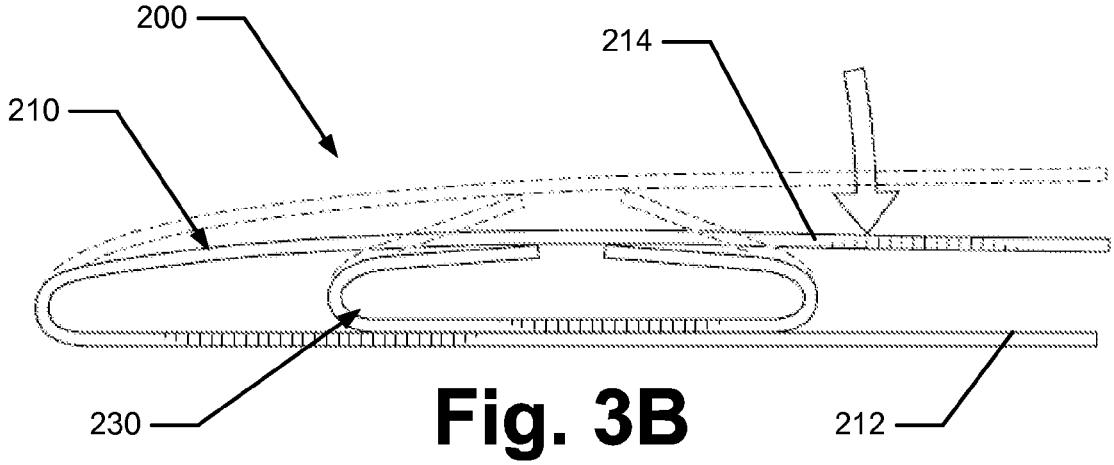
Figure 3C:
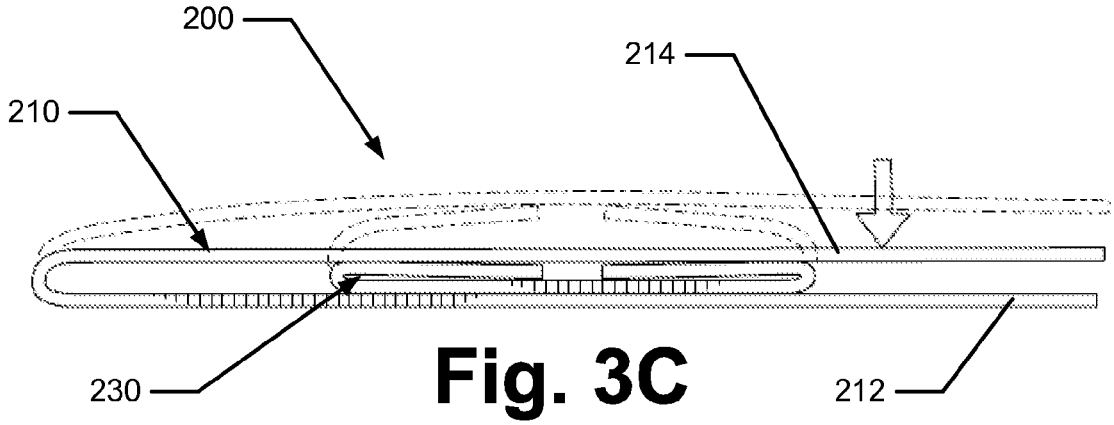

FIGS. 3A through 3C illustrate the support assembly 200, e.g., when a user stands, takes a step, or lands a jump in a shoe 100 with the support assembly 200. At the beginning of the support member compressing cycle (e.g., when the foot is still up in the air), the support assembly 200 is in the uncompressed position as illustrated in FIG. 2A. As the user takes a step with the shoes 100 on his/her feet, the heel area 124 of the shoe 100 will contact the ground. The impact force from this contact will cause the primary biasing element 210 to start compressing with the flexing member 214 bending toward the base member 212 as illustrated in FIG. 3A. If the landing force is light (e.g., in a walking step, when standing still, etc.), this initial degree of bending of only the primary biasing element 210 may be sufficient to completely absorb and attenuate the impact force (e.g., depending, perhaps, on the weight of the wearer). Bending of the primary biasing element 210 provides a nice, soft feel underfoot, as the spring features of the primary biasing element 210 (e.g., material stiffness, material thickness, moment arm length, spring constant, etc.) may be selected to bend relatively easily (based on the expected load for the shoe). FIG. 3A, however, shows the flexing member 214 bent toward the base member 212 to a location where it also is beginning to engage and compress the secondary biasing element 230. This may take place, for example, under a heavier load, e.g., when landing a running step, when landing a jump, etc. As the higher load lands, the support assembly 200 further compresses as the user's weight is transferred to the heel area 124 of the shoe 100. The primary biasing element 210 continues to compress more with the flexing member 214 moving further downward toward the base member 212, and, as illustrated in FIG. 3B, with the flexing member 214 beginning to contact and compress the secondary biasing element 230. When the secondary biasing element 230 is compressed, the first flexing arm 232 and the second flexing arm 234 begin moving toward the base arm 236 of the secondary biasing element 230 (thereby bending the secondary biasing element 230 at its curved outer edges). Bending of the secondary biasing element 230 further attenuates the impact forces and slows the downward motion of the foot.

FIG. 3C illustrates the support assembly 200 at the end of a compression cycle and the beginning of the rebound cycle (although the assembly 200 need not compress to the complete extent illustrated in FIG. 3C during all or even during any individual compression cycle). As the shoe 100 continues to contact the ground, the weight of the user begins to shift from the rear of the sole to the middle and front of the sole (e.g., as the user begins the push-off or toe-off phases of a step or jump). This shifting weight reduces the force applied to the support assembly 200, which begins the rebound cycle for the support assembly 200. The stored energy from the compression cycle (e.g., due to flexing of the material at the outer edges of the primary and secondary biasing elements 210, 230) is released during the rebound cycle as the secondary biasing element 230 and the primary biasing element 210 spring back to their original configurations (e.g., due to the resilient nature of the materials used to form the assembly 200). At the start of the rebound cycle, the flexing member 214 of the primary biasing element 210 and the flexing arms 232, 234 of the secondary biasing element 230 exert a dual lifting or rebound force to the shoe 100 (heel). When springing back beyond the point shown by the solid lines in FIG. 3A, only the primary biasing element 210 exerts the lifting or rebound force to the heel. As the weight of the user fully transfers off the heel and to the front sole section of the shoe 100, the support assembly 200 will fully spring back to the uncompressed position, e.g., as illustrated by the broken lines in FIG. 3A.

Figure 4:
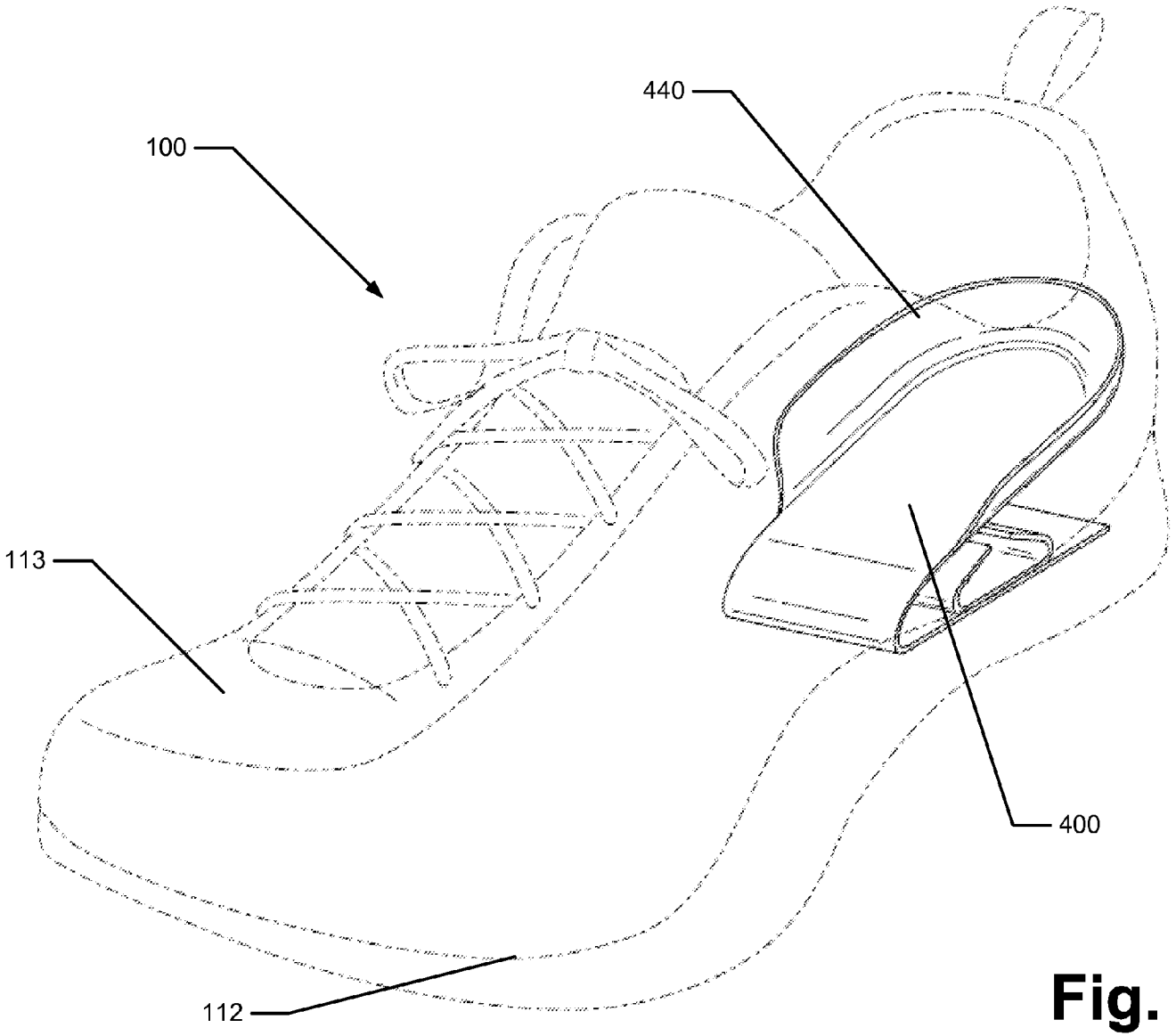
FIG. 4 illustrates an article of footwear that includes another example biasing support member according to at least some embodiments of the invention.
Figure 5A:
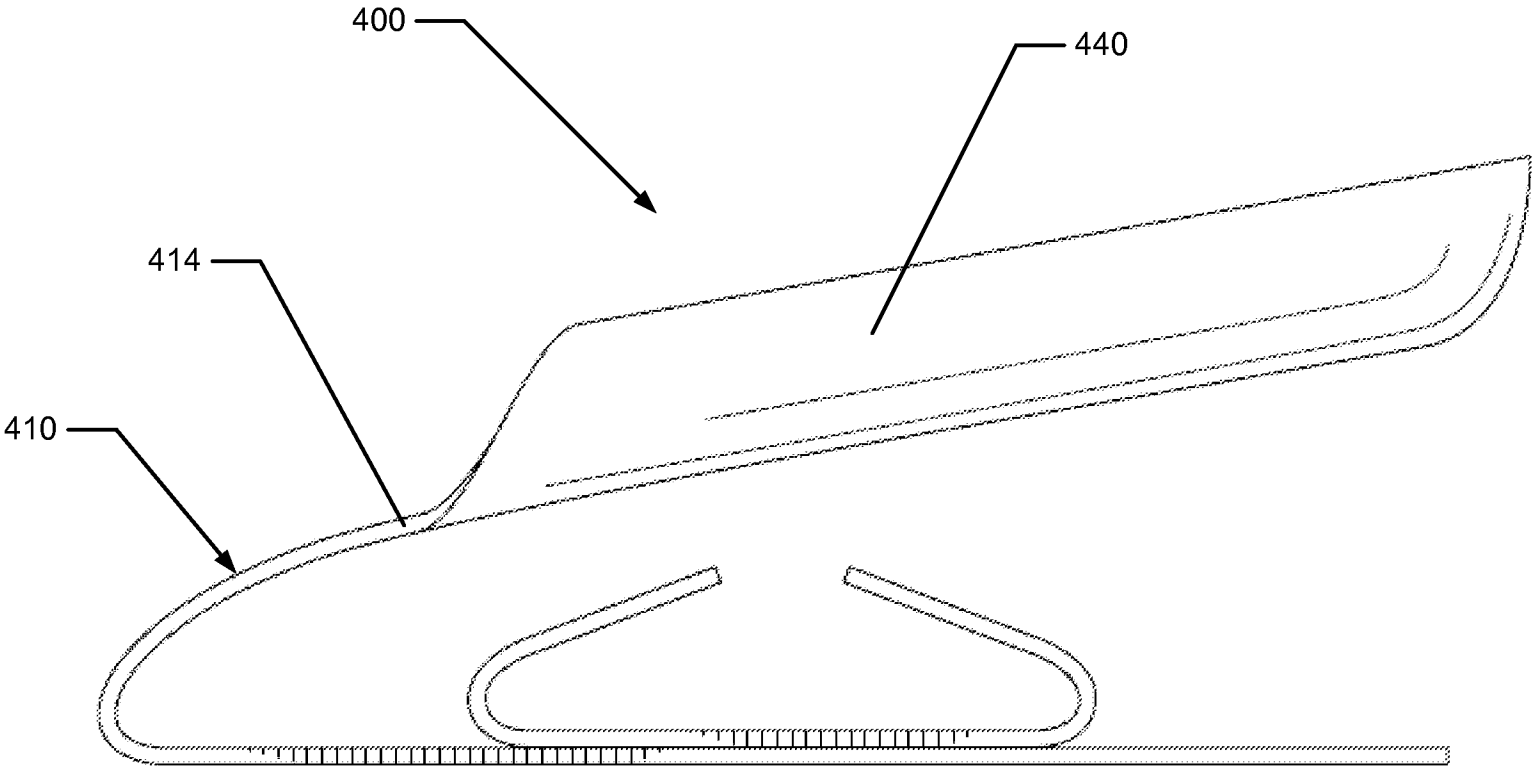
FIG. 5A illustrates a side view of the biasing support member shown in FIG. 4 for supporting the plantar surface of a wearer's foot, at least in a heel area.
Figure 5B:
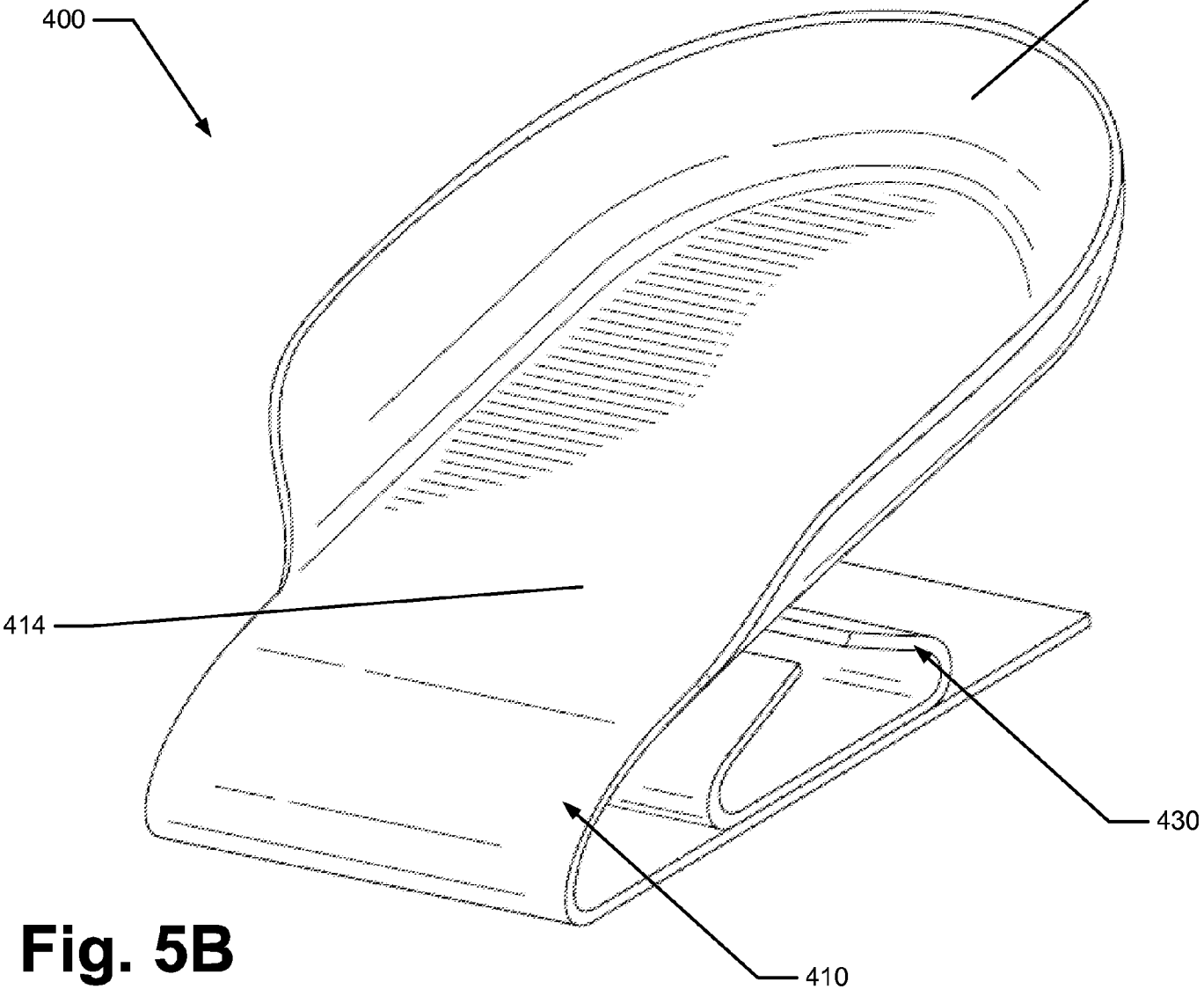
FIG. 5B illustrates an angled perspective view of the biasing support member shown in FIG. 5A.

FIGS. 4, 5A, and 5B illustrate another support assembly 400 for supporting at least a portion of the plantar surface of a wearer's foot in a shoe 100. This support assembly 400 includes a raised perimeter wall 440. The raised perimeter wall 440 may be located at the rear heel area of the support assembly 400 and may extend around the rear heel area of the flexing member 414 of the primary biasing element 410. The raised perimeter wall 440 may be raised up from a plantar support surface of the flexing member 414 at its outer edges by any desired height without departing from this invention. In the illustrated example, for men's shoes (e.g., sizes about 9 to 13), the raised perimeter wall 440 may be raised up at its highest points from about 2 mm to about 35 mm, and if desired, it may function in a manner akin to a conventional heel counter structure (e.g., to help maintain the wearer's heel in place on the sole structure). The raised perimeter wall 440 may be engaged with the shoe upper 113, with a midsole component (if any), and/or with any other desired footwear component without departing from this invention. Additionally, the raised perimeter wall 440 may be located at an exterior surface, at an interior surface, and/or between layers of a finished footwear product. The support assembly 400 of FIGS. 4, 5A, and 5B may have any of the features or options described above for the assembly 200 of FIGS. 1 through 3C, and it may function in the same or in similar manners (including the two stage compression and energy return features described in conjunction with FIGS. 3A-3C).

Figure 6:
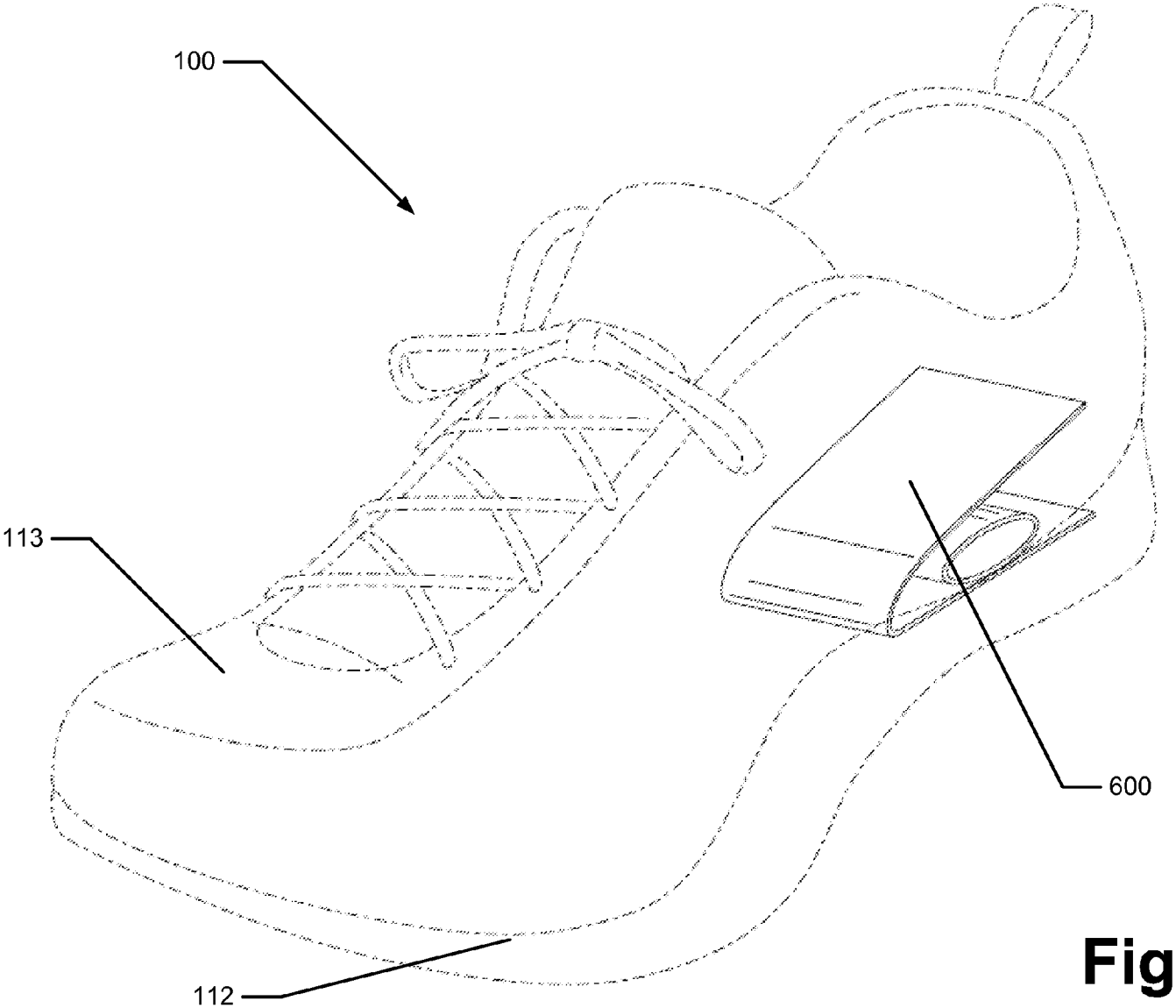
FIG. 6 illustrates an article of footwear that includes another example biasing support member according to at least some embodiments of this invention.
Figure 7A:
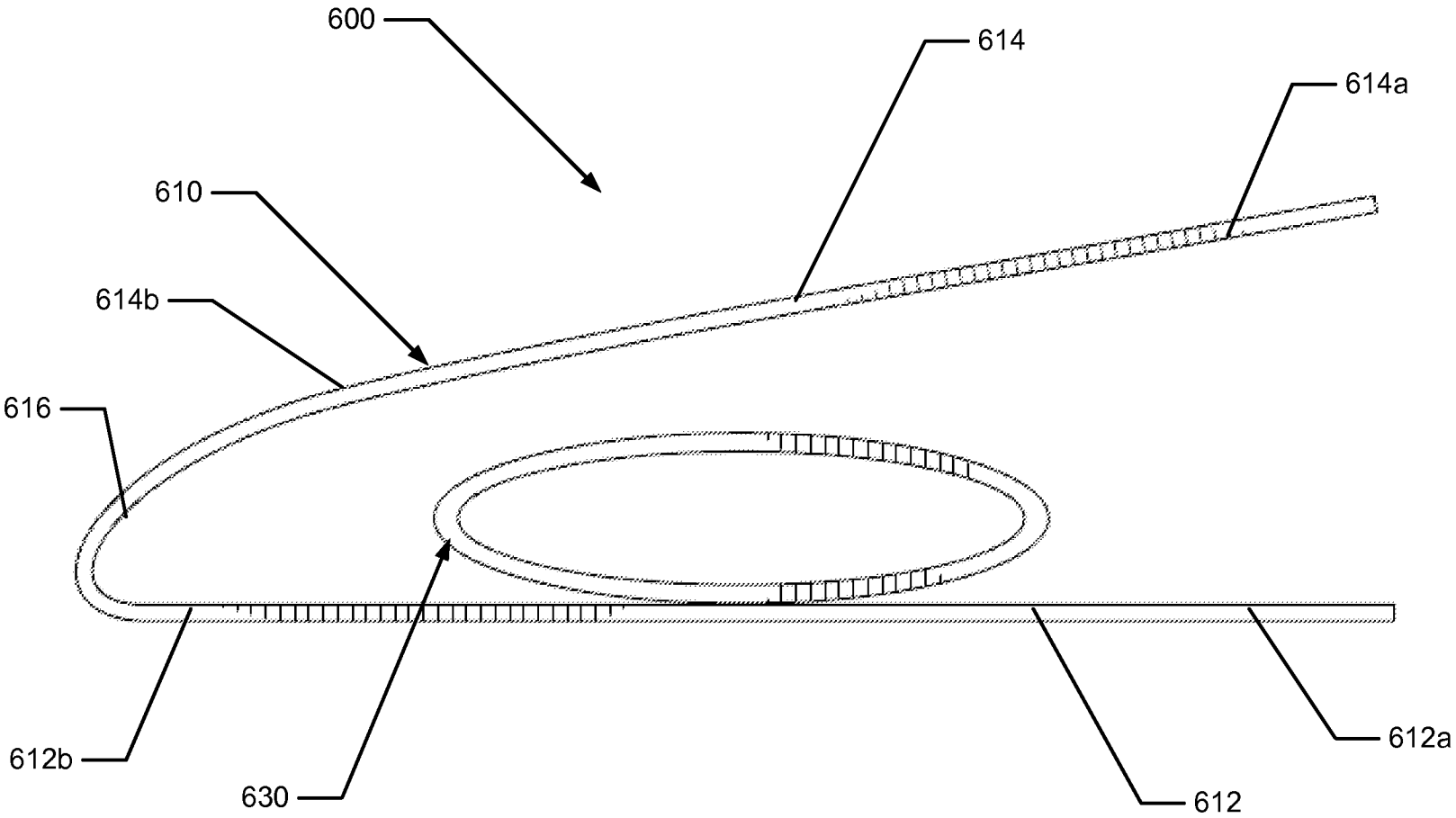
FIG. 7A illustrates a side view of the biasing support member shown in FIG. 6 for supporting the plantar surface of a wearer's foot, at least in a heel area.
Figure 7B:
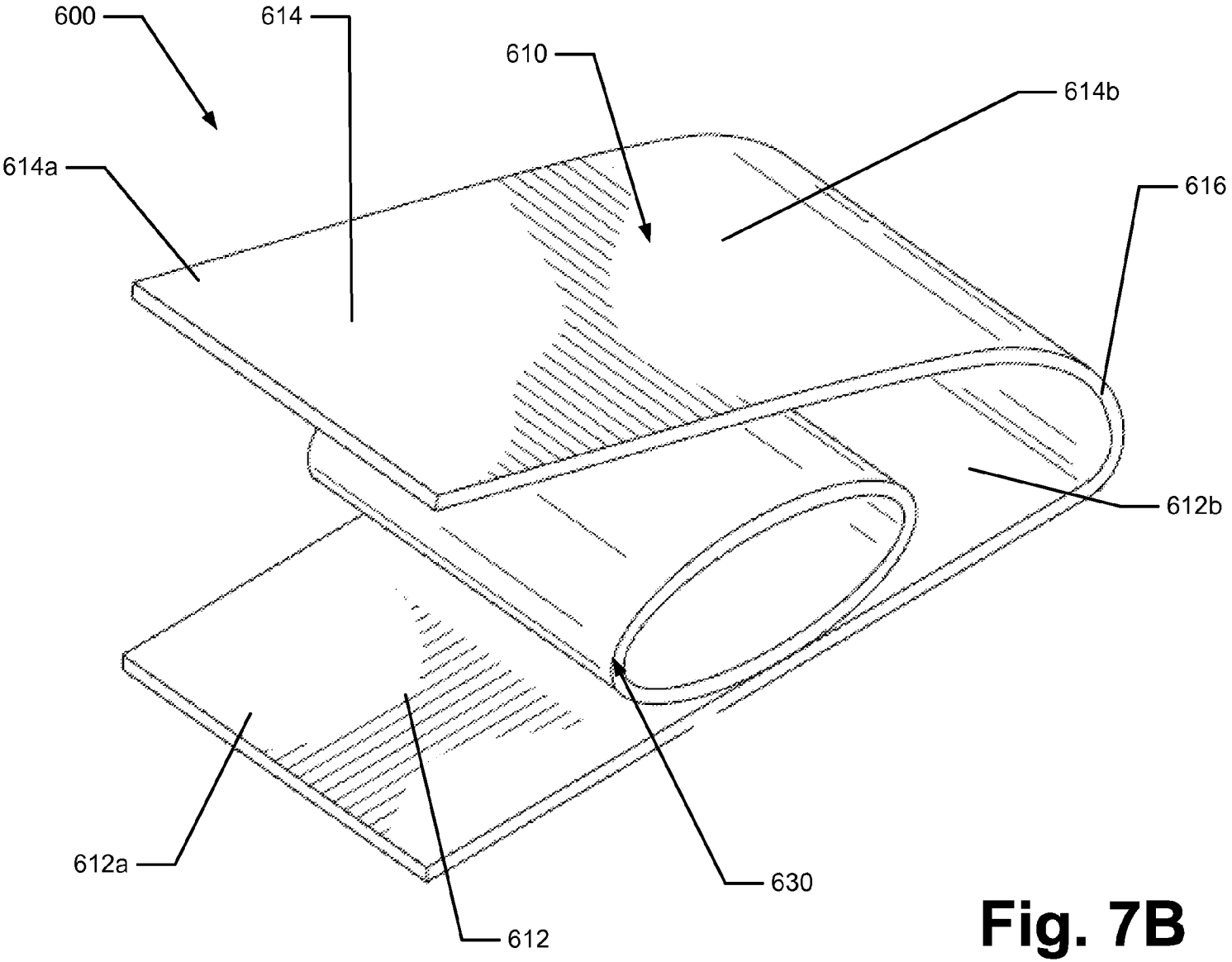
FIG. 7B illustrates an angled perspective view of the biasing support member shown in FIG. 7A.

FIGS. 6, 7A, and 7B illustrate another example foot support member in the form of a spring or biasing foot support assembly 600 that can help provide impact force attenuation and a soft feel underfoot, optionally in combination with a conventional midsole, and can also provide return energy to the plantar surface of a wearer of a shoe. The support assembly 600 illustrated in FIGS. 6, 7A, and 7B provides support for at least a heel area of a plantar surface of a wearer's foot. This spring type support assembly 600 may be provided at any desired location within a shoe construction, e.g., immediately beneath an insole, sock liner, or strobel member; included within or on top of a midsole component; between a midsole component and an outsole component; between a strobel member and an outsole component; etc.

FIG. 6 illustrates a shoe 100 that includes a support assembly 600 in accordance with this example of the invention. So as to indicate the location of support assembly 600 within the shoe 100, some parts of shoe 100 are shown in FIG. 6 with broken lines. FIG. 7A illustrates a side view of the support assembly 600 for biasing the plantar surface of a wearer's foot, and FIG. 7B shows a top-perspective view of this support assembly 600.

The support assembly 600 includes primary biasing element 610 and a secondary biasing element 630. The primary biasing element 610 and the secondary biasing element 630 may be fixed to each other or engaged with each other by many known methods, such as via adhesives or cements, via mechanical connectors, via fusing techniques, or the like. The various elements of the support assembly 600 may be made from any desired materials without departing from this invention, including the materials described above for support assembly 200 of FIGS. 1-3C. Also, the support assembly 600 may be made of any number of individual parts without departing from this invention, including a two-piece construction as shown in FIGS. 6, 7A, and 7B. As other options, the support assembly 600 may be made from rigid plastic materials as one, two, or even more pieces, e.g., by molding techniques.

In this illustrated example structure 600, the primary biasing element 610 is located in the heel area 124 of the shoe 100, extending from the rear heel area 124 to the forward heel or to the midfoot area 122 of the shoe 100. The primary biasing element 610 of this example includes a base member 612, a flexing member 614, and a biasing or spring member 616. The biasing member 616 may connect the base member 612 and the flexing member 614, optionally as a unitary, one piece construction. The primary biasing element 610 may be in the form of a V-shaped spring assembly.

The base member 612 may be an elongate, substantially rigid and thin plate that may be formed integrally as part of the sole structure 112 of the shoe 100. The base member 612 may be rectangular or other shapes without departing from this invention. The base member 612 may also be located along the sole structure 112 of the shoe 100 (e.g., optionally at least partially fit into a groove, recess, or opening formed in a midsole or outsole member, if desired). The base member 612 includes a free end 612*a* and an opposite biasing end 612*b* that is attached to, adjacent to, or integrally formed with the biasing member 616. The free end 612*a* may be located closer to or at the heel area 124 of the shoe 100 while the biasing end 612*b* may be located closer to or at the midfoot area 122 of the shoe 100. The width of the base member 612 may be approximately the width of the sole structure 112 of the shoe 100 at the heel area, as illustrated in FIG. 6. Additionally, the width of the base member 612 may be less than the width of the sole structure 112 of the shoe 100 according to other embodiments. The base member 612 may have one or more openings defined through it, e.g., to lighten its weight, to change its flex characteristics, and/or to provide an interesting aesthetic appearance.

The flexing member 614 may also be an elongate, substantially rigid and thin plate that extends along and underlies the heel area 124 of the shoe 100. The flexing member 614 may be rectangular or other shapes without departing from this invention. The flexing member 614 includes a free end 614*a* and an opposite biasing end 614*b* that is attached to, adjacent to, or integrally formed with the biasing member 616. The free end 614*a* may be located closer to or at the heel area 124 of the shoe 100 while the biasing end 614*b* may be located closer to or at the midfoot area 122 of the shoe 100. The width of the flexing member 614 may be approximately the width of the sole structure 112 of the shoe 100 at the heel area as illustrated in FIG. 6. Additionally, the width of the flexing member 614 may be less than the width of the sole structure 112 of the shoe 100 according to other embodiments. The flexing member 614 and the base member 612 may have approximately the same width. The flexing member 614 may have one or more openings defined through it, e.g., to lighten its weight, change its appearance, and/or alter its stiffness and/or flex characteristics. The flexing member 614 also may at least partially fit into a groove, recess, or opening defined in the upper or midsole component, if desired.

The biasing member 616 may integrally join the base member 612 and the flexing member 614 to form the primary biasing element 610. The biasing member 616 may provide a V-shaped apex 616*a* of the primary biasing element 610. The angular configuration of the biasing member 616 and the V-shaped apex 616*a* may provide different stiffnesses and/or spring constants for the primary biasing element 610 and the spring assembly 600. The biasing member 616 may have different angular configurations and therefore differing flexing characteristics in accordance with other embodiments. The type of material, the thickness of the various portions, the size and/or locations of any grooves and/or openings, and the like, may affect the flex characteristics of the primary biasing element 610. The volume defined by the primary biasing element 610 may be considered as the internal volume contained between members 612, 614, and 616 assuming that the open sides and free end are closed off by flat planar surfaces connecting the edges of the members 612, 614, 616.

Additionally, in this illustrated example structure 600, a secondary biasing element 630 is located within the heel area 124 of the shoe 100. The secondary biasing element 630 may be located on and along the base member 612 of the primary biasing element 610, or it may project through an opening defined through the primary biasing element 610. The secondary biasing element 630 may be located at least partially within the volume defined by the primary biasing element, e.g., at least partially between the base member 612 and the flexing member 614, at least partially beneath the flexing member 614, etc., such that the base member 612 and/or the flexing member 614 can engage the secondary biasing element 630 upon the bending or flexing of the flexing member 614 as will be described below in more detail. As illustrated in FIGS. 6, 7A, and 7B, the secondary biasing element 630 may be in the form of an oval spring member. The secondary biasing element 630 may be fixed to the primary biasing element 610 by many known methods such as via adhesives or cements, via mechanical connectors, via fusing techniques, or the like, but it need not be fixed to it (e.g., if the secondary biasing member 630 is located within a groove or opening in the primary biasing member 610, then the secondary biasing member 630 may be fixed to another footwear component, such as to any outsole or midsole structure underlying base member 612). The secondary biasing element 630 also may be engaged with (and thus move with) the flexing member 614, e.g., movable toward and into contact with the base member 612 or another footwear component located beneath the secondary biasing element 630.

The support assembly 600 of FIGS. 6 through 7B may function in the same or similar manner to the assemblies 200, 400 of FIGS. 1 through 5B described above, including with the potential use of the same two stage compression and energy return features described above in conjunction with FIGS. 3A-3C. In this assembly 600, compression of the oval shaped secondary biasing element 630 provides impact force attenuation at least under higher loads. Also, the spring assembly 600 may have any of the features or options described above for assemblies 200, 400, including the raised perimeter wall 440 shown in the example of FIGS. 4, 5A, and 5B.

Other features or structures are possible without departing from this invention. For example, the secondary biasing element 600 of FIGS. 6 through 7B is shown as a complete oval like structure. As another alternative, a similar structure and result could be achieved if the bottom wall of this oval was not present (e.g., a top curved wall shaped like the top of the oval may be engaged with the base 612 or another footwear component by two side arms (e.g., akin to the C-shaped assembly 200 of FIGS. 1 through 3C tipped on its side so the curved surface was at the top)). The materials, thicknesses, angular features, sizes, shapes, groove and/or opening configurations, and the like of the biasing elements 210, 230, 610, 630, etc., may be altered to control the stiffness (and thus the flexibility characteristics) of the overall biasing elements and the overall support assemblies 200, 400, 600.

Support assemblies 200, 400, 600 of the types described above also may be incorporated into an article of footwear in any desired manner without departing from this invention. For example, the assemblies 200, 400, 600 may be at least partially exposed at the exterior of the finished shoe product. As other examples, the assemblies 200, 400, 600 may be at least partially enclosed (and in some examples, fully enclosed) within another footwear component so that they are not seen (or not completely seen) at the exterior of a finished shoe. As a more specific example, if desired, the assemblies 200, 400, 600 may be at least partially contained within a conventional midsole component, such as within a cavity provided in a polymeric foam midsole element, etc. As yet additional potential features, if desired, additional foam, springs, fluid-filled bladders, and/or other impact force attenuating structure(s) may be provided within internal volumes defined by the V-shaped, C-shaped, and/or oval shaped biasing components in order to further control or alter their bending and flexing properties (e.g., the areas of the assemblies near the sharper curves or bends (e.g., area 216 and areas at the corners of C-shaped element 230) may include additional foam, bladders, or spring supports of the types described above).

Additionally, the example sole structures shown in FIGS. 1-7B have a single support assembly 200, 400, or 600 provided in the heel area of a shoe. Other structures and arrangements are possible without departing from this invention. For example, two support assemblies of the types described above could be provided side-by-side in the heel area of a shoe (e.g., a medial side support assembly and a lateral side support assembly). Other arrangements of two or more assemblies 200, 400, 600 may be provided in the heel, such as in a front-to-back relative orientation. Similar assemblies could be provided in other areas of the shoe as well, such as in the forefoot area (particularly at the area beneath the big toe and the adjacent toe with the biasing elements oriented in the same direction as those shown in the heel, for supplying additional rebound energy during the push off or toe off phase). When multiple support assemblies 200, 400, 600 are provided in a single shoe, the assemblies may have the same or different structures, constructions, and/or spring/flex characteristics.

While variations are possible, the various portions of the support members 200, 400, 600 may be formed as thin, rigid plates, e.g., from materials as generally described above. These plates may have any desired thickness, e.g., depending on the desired degree of stiffness, return energy, and/or impact force attenuation. As some more specific examples, the plate portions of the support assemblies 200, 400, 600 may have thicknesses of less than 10 mm, and in some examples, less than 8 mm, or even less than 6 mm. The plate thicknesses may vary at different locations of a single support assembly 200, 400, 600.

In addition to articles of footwear, aspects of this invention can be practiced with other types of "foot-receiving devices" (i.e., any device into which a user places at least some portion of his or her foot). In addition to all types of footwear or shoes (e.g., as described above), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like. Such foot-receiving devices may include: (a) a foot-covering component (akin to a footwear upper) that at least in part defines an interior chamber for receiving a foot; and (b) a foot-supporting component (akin to the footwear sole structure) engaged with the foot-covering component, wherein the foot-supporting component includes one or more support assemblies of the types described above. Structures for providing the heel impact force attenuation characteristics, as described above, may be incorporated in the foot-supporting component of any desired type of foot-receiving device.

The foregoing description of the invention has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, subcombinations and permutations of features from above-described embodiments are the within the scope of the invention. With regard to claims directed to an apparatus, an article of manufacture or some other physical component or combination of components, a reference in the claim to a potential or intended wearer or a user of a component does not require actual wearing or using of the component or the presence of the wearer or user as part of the claimed component or component combination.

The invention claimed is:

1. An article of footwear, comprising:

an upper; and a sole structure engaged with the upper, wherein the sole structure includes a support member for at least a heel area of the sole structure, wherein the support member includes:

a primary biasing element including a V-shaped spring assembly having a base member and a flexing member; and a secondary biasing element located at least partially beneath the flexing member of the primary biasing element, wherein when the flexing member moves toward the base member beyond a predetermined extent, the flexing member engages and bends the secondary biasing element, the secondary biasing element including a base portion, a front portion that initially curves upwardly and forwardly from the base portion and then curves upwardly and rearwardly, and a rear portion that initially curves upwardly and rearwardly from the base portion and then curves upwardly an forwardly.

2. An article of footwear according to claim 1, wherein the secondary biasing element is in the shape of a C-shaped spring.

3. An article of footwear according to claim 1, wherein the secondary biasing element is in the shape of an oval spring.

4. An article of footwear according to claim 1, wherein the secondary biasing element is fixed to the base member of the primary biasing element.

5. An article of footwear according to claim 1, wherein the primary biasing element is formed from a rigid polymeric material.

6. An article of footwear according to claim 1, wherein the secondary biasing element is formed from a rigid polymeric material.

7. An article of footwear according to claim 1, wherein the primary biasing element includes a raised perimeter wall that extends around a rear heel area of the flexing member, from a medial side area of the flexing member to a lateral side area of the flexing member.

8. An article of footwear according to claim 7, wherein the raised perimeter wall is raised at its highest points between 2 mm to 35 mm.

9. An article of footwear according to claim 1, wherein the base member is an elongate, substantially rigid plate.

10. An article of footwear according to claim 1, wherein the base member and the flexing member are formed as a unitary, one-piece construction.

11. An article of footwear according to claim 1, wherein the flexing member is an elongate, substantially rigid plate.

12. An article of footwear according to claim 1, wherein the primary biasing element and the secondary biasing element are formed as a unitary, one-piece construction.

13. An article of footwear according to claim 1, wherein the secondary biasing element extends through an opening or groove formed in the base member of the primary biasing element.

14. An article of footwear according to claim 1, wherein each of the base member and the flexing member is an elongate, substantially rigid plate.

15. A foot support member, comprising:

a primary biasing element including a V-shaped spring assembly having a base member and a flexing member; and a secondary biasing element engaged with one of the base member or the flexing member and located at least partially beneath the flexing member, wherein when the flexing member moves with respect to the base member beyond a predetermined extent under an applied load, motion of the flexing member bends the secondary biasing element, the secondary biasing element including a base portion, a front portion that curves upwardly and forwardly from the base portion and then upwardly and rearwardly, and a rear portion that curves upwardly and rearwardly from the base portion and then upwardly and forwardly.

16. A foot support member according to claim 15, wherein the secondary biasing element is in the shape of a C-shaped spring.

17. A foot support member according to claim 15, wherein the secondary biasing element is in the shape of an oval spring.

18. A foot support member according to claim 15, wherein the secondary biasing element is engaged with the base member of the primary biasing element via an adhesive.

19. A foot support member according to claim 15, wherein the primary biasing element includes a raised perimeter wall that extends around a free end of the flexing member, from a first side of the flexing member to a second side of the flexing member.

20. A foot support member according to claim 19, wherein the raised perimeter wall is raised at its highest points with respect to a base surface of the flexing member between 2 mm to 35 mm.

21. A foot support member according to claim 15, wherein the base member and the flexing member are formed as a unitary, one-piece construction.

22. A foot support member according to claim 15, wherein the primary biasing element and the secondary biasing element are formed as a unitary, one-piece construction.

23. A foot support member according to claim 15, wherein each of the base member and the flexing member is an elongate, substantially rigid plate.

24. A foot-receiving device, comprising:

a foot-covering member; and a foot-supporting member engaged with the foot-covering member, wherein the foot-supporting member includes a foot support member according to claim 15.

25. An article of footwear, comprising:

an upper; and a sole structure engaged with the upper, wherein the sole structure includes a foot support member according to claim 15.

* * * * *